US006555736B1

(12) United States Patent
Delosreyes

(10) Patent No.: US 6,555,736 B1
(45) Date of Patent: Apr. 29, 2003

(54) RHYTHM SHAKER

(75) Inventor: Daniel Delosreyes, New York, NY (US)

(73) Assignee: Latin Percussion, Inc., Garfield, NJ (US)

( * ) Notice: Subject to any disclaimer, the term of this patent is extended or adjusted under 35 U.S.C. 154(b) by 0 days.

(21) Appl. No.: 10/050,674

(22) Filed: Jan. 16, 2002

(51) Int. Cl.[7] ..... G10D 13/08
(52) U.S. Cl. ..... 84/402
(58) Field of Search ..... 84/402, 403, 404, 84/410; 446/418, 419, 421, 422

(56) References Cited

U.S. PATENT DOCUMENTS 5,659,143 A * 8/1997 Isackson ..... 84/402
5,814,747 A * 9/1998 Ramsell ..... 84/402
6,365,810 B1 * 4/2002 Enhoffer et al. ..... 84/402

* cited by examiner

*Primary Examiner*—Shih-Yung Hsieh
(74) *Attorney, Agent, or Firm*—Ohlandt, Greeley, Ruggiero & Perle, L.L.P.

(57) ABSTRACT

There is provided a rhythm shaker for producing percussive sound. The shaker has a shell that envelops a hollow interior that contains a number of percussive particles. There is also provided a sound dampening insert that covers all but a portion of the interior surface of the shell. The rhythm shaker's shell has only one surface on which the enclosed sound producing material can strike the shell and make a sound. The remainder of the shell's surfaces are protected or covered with the sound dampening insert that mutes or dampens the sound by preventing the sound producing material from striking against the interior surface of the shell.

27 Claims, 3 Drawing Sheets

RHYTHM SHAKER

BACKGROUND OF THE INVENTION

1. Field of the Invention

The present invention relates to musical instruments. In particular, the present invention relates to percussion instruments known as musical shakers.

2. Description of the Prior Art

Musical shakers in various forms are often used in the rhythm sections of orchestras and other musical groups to establish rhythm in musical performances. Their use has crossed over into virtually every form of music. A typical musical shaker is a hollow container or shell, having a number of relatively small percussive or sound producing material or media, such as metal shot, plastic beads, seeds or small stones, contained therein. The sound producing media hits the inside surface of the container when shaken and produces a percussive sound.

A musical shaker is played by moving it rapidly from one position to another. The percussive media (shot, beads, etc.) occupy a relatively small proportion of the internal volume of the instrument and travel between the internal walls of the container. Sounds are produced when the media impacts the container walls and itself, thereby generating vibrations and sound. When this action is repeated, the sound produced establishes rhythm in musical performances and can add dimension to the ambient music.

Most typical shakers are tubular in construction and shape with capped ends or sealed permanently inside. In the typical shaker known in the prior art, the fill or sound producing media freely flows inside the shell producing sound as the shaker is manipulated. The sound is produced both in the back and forth movement. The shakers known in the prior art are typically constructed of various materials including wood, metal, ceramics and plastic.

A disadvantage present with the traditional shakers described above is that the fill or sound producing media naturally tends to hit the entire inner surface of the container in an uncontrolled manner. Consequently, there exists a need for a musical shaker instrument where the fill or sound producing material or media strikes a controlled area of the outer shell so that the shaker makes sound in only one direction. This allows the musician to play very controlled, tight, rhythmic sounds. This also permits the musician to play a shaker in both hands, while allowing for fast, intricate articulated rhythms.

SUMMARY OF THE INVENTION

It is an object of the present invention to provide a rhythm shaker where the sound producing material strikes only a controlled or desired area of the shaker, preferably a controlled area on the outer shell of the shaker.

It is another object of the present invention to provide such a rhythm shaker that makes sound in one direction.

It is still another object of the present invention to provide such a rhythm shaker that provides the user with better control and manipulation of the sound.

These and other objects and advantages of the present invention are achieved by a rhythm shaker that has a single side or section on which the enclosed sound producing material can strike a wall or surface of the shaker and, thus, make a sound. The remainder of the walls or surfaces of the shaker are protected or covered with a material that prevents the sound producing material from striking against those walls or surfaces thereby muting or dampening, if not entirely eliminating, sound being produced against such walls and surfaces.

BRIEF DESCRIPTION OF THE DRAWINGS

These and other embodiments of the present invention will be appreciated by referring to the drawings that include

DETAILED DESCRIPTION OF THE INVENTION

Figure 1:
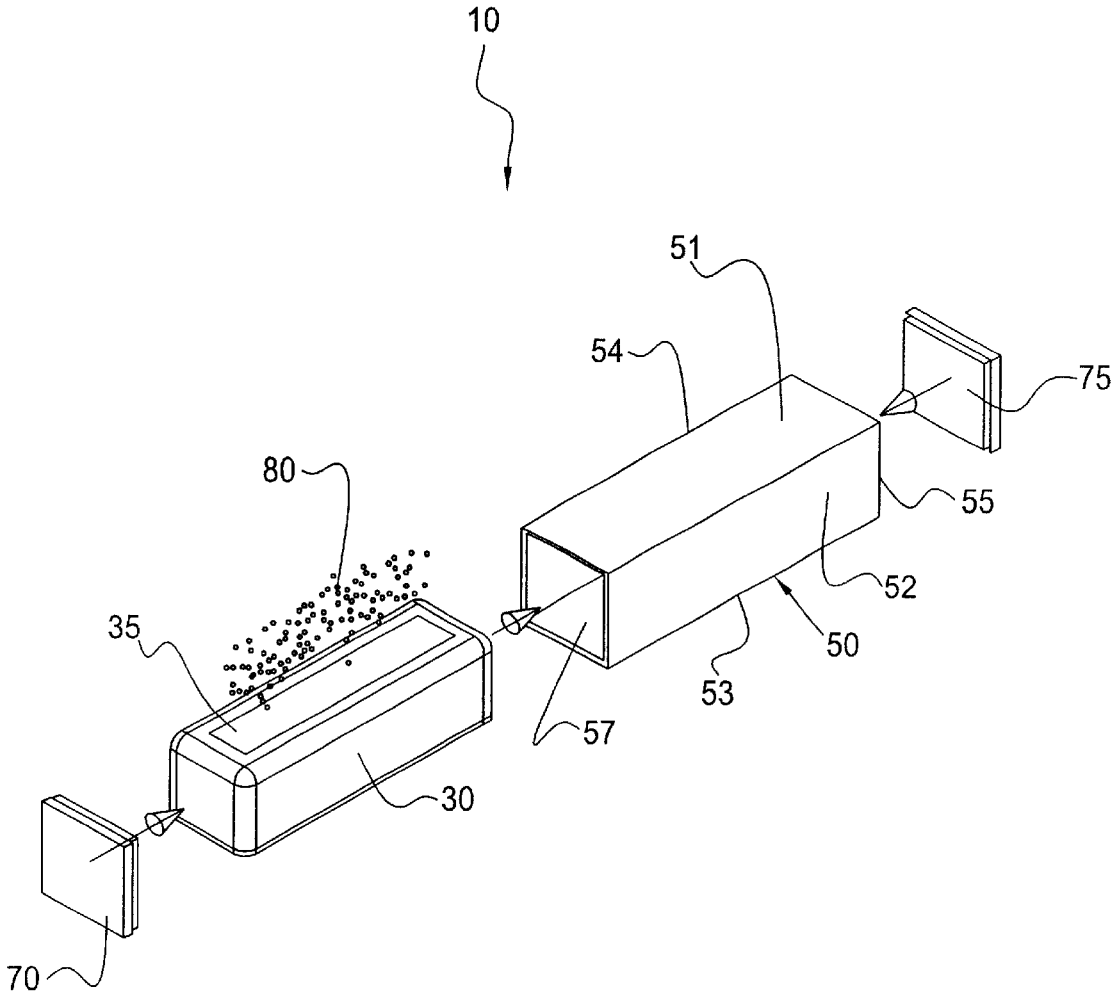
FIG. 1 is an exploded view of the rhythm shaker of the present invention.

Referring to the figures and particularly to FIG. 1, there is shown a rhythm shaker generally represented by reference numeral 10. In a preferred embodiment shown in FIG. 1, rhythm shaker 10 has a dampening insert or container 30, a shell 50 that is adapted to sleeve over the insert, and a pair of end caps 70 and 75 that are adapted to enclose the insert in the sleeve. In a preferred embodiment, rhythm shaker 10 is preferably rectangular in shape. However, shaker 10 can have virtually any configuration as shown in FIGS. 2 to 6.

As shown in FIG. 1, dampening insert 30 is preferably rectangular in shape with one long side surface forming an opening 35. Insert 30 also preferably has a square cross-section. Shell 50 also preferably has a square cross-sectional shape, is preferably rectangular. Moreover, shell 50 corresponds generally to the overall shape and dimensions of insert 30, but is slightly larger in circumference in order to sleeve over the insert. In a preferred embodiment shown in FIG. 1, shell 50 has a hollow body with four closed or connected side surfaces 51, 52, 53 and 54, and two open ends 55 and 57. However, in alternative embodiments, shell 50 can have one open end and a corresponding one end cap. Preferably, shell 50 has a nominal wall thickness. Such a nominal wall thickness preferably is about 0.5 millimeters (mm) to about 2.5 mm in thickness.

Shell 50 and end caps 70 and 75 of rhythm shaker 10 may be made from any traditional material. For example, shell 50 and end caps 70, 75 can be made out of rigid material. Such a rigid material includes, but is not limited to, plastic, metal, wood, or bamboo. Dampening insert 30 can be made from any sound deadening material. Such material includes, but is not limited to, cloth, rubber, silicone, or foam. Dampening insert 30 is preferably made from material that is pliable, and thus can be adapted to any different shape.

Dampening insert 30 is adapted to be removably inserted into shell 50. In a preferred embodiment shown in FIG. 1, percussive media 80 is placed in dampening insert 30, preferably through opening 35. Percussive media 80 can be any type of sound producing material. Such sound producing material includes, but is not limited to, metal shot, buckshot, plastic bead, glass bead, pellet, seed, rice or small stone. Dampening insert 30 having a number of percussive media 80 is inserted inside shell 50. Opening 35 of dampening insert 30 is positioned to face one closed side surfaces 51 to 54 of shell 50. End caps 70 and 75 are then inserted into end surfaces 55 and 57 to seal off or close shell 50.

Shell 50 envelops dampening insert 30, the cavity inside the hollow body, and the percussive media 80. Preferably, end caps 70 and 75 are inserted into end surfaces 55 and 57 of shell 50 to form a sealed surface on the shell.

As set forth above, a configuration is created in which there is only one side or surface 51 to 54 on which percussive media 80 can strike shell 50, and thus make a sound. The rest of the surfaces 51 to 54 that may come into contact with percussive media 80 are protected or covered with the sound-dampening material of dampening insert 30, thereby preventing percussive media 80 from striking against exterior shell 50 and thus preventing the percussive media from making a sound against those surfaces. Sound dampening insert 30 mutes or dampens sound by preventing the sound producing percussive media 80 from striking against the interior surface of shell 50 that is protected by insert 30.

As described above, rhythm shaker 10 may be constructed from any traditional material. Furthermore, rhythm shaker 10 can be any size and shape. It can be round, square, oval, triangular or any other configuration.

Figure 2:
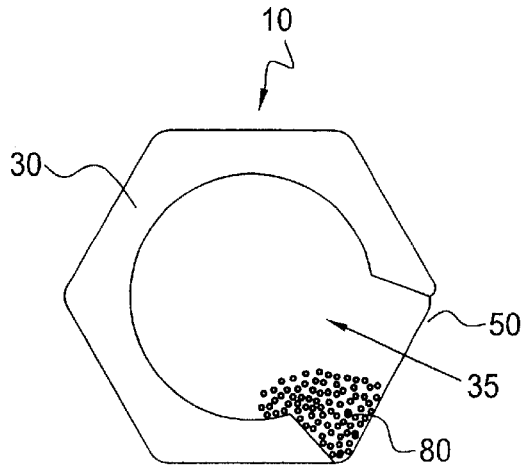
FIG. 2 is a cross-sectional view of an alternative embodiment of the rhythm shaker of the present invention.

In an alternative embodiment shown in FIG. 2, outer shell 50 has a hexagonal cross-sectional shape or configuration. In this embodiment, percussive media 80 are allowed to strike, and thus make sound, on only one of the six sides or surfaces of shell 50. Thus, the rest of the sides are insulated by dampening insert 30.

Figure 3:
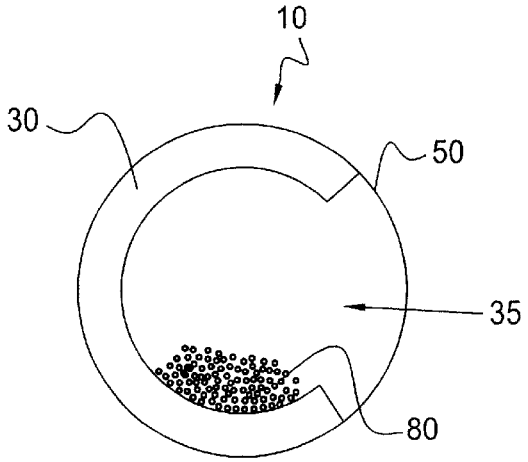
FIG. 3 is a cross-sectional view of a second alternative embodiment of the rhythm shaker of the present invention.

In a second alternative embodiment shown in FIG. 3, shell 50 has a circular cross-sectional shape. In this embodiment, percussive media 80 are again allowed to strike, and thus make sound, on only a portion of the interior surface of shell 50. Again, the remainder of the interior surface of shell 50 is insulated by dampening insert 30.

Figure 4:
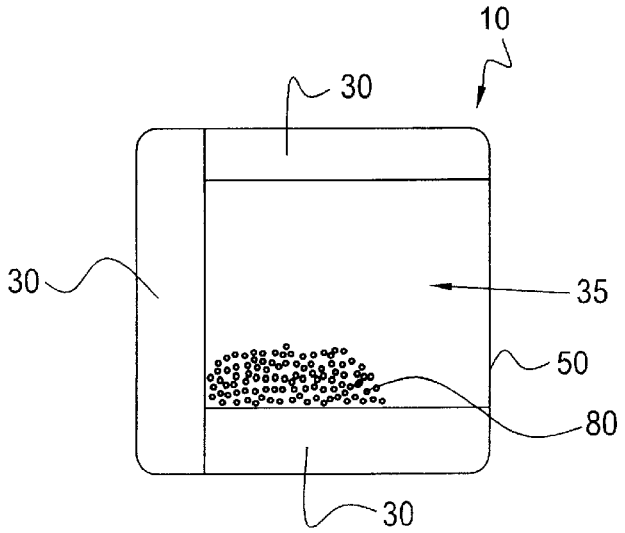
FIG. 4 is a cross-sectional view of a third alternative embodiment of the rhythm shaker of the present invention.

In a third alternative embodiment shown in FIG. 4, shell 50 has a square cross-sectional shape or configuration. In this embodiment, percussive media 80 are allowed to strike and make sound on one of the four sides or surfaces of shell 50, with dampening insert 30 insulating from striking the other three sides.

Figure 5:
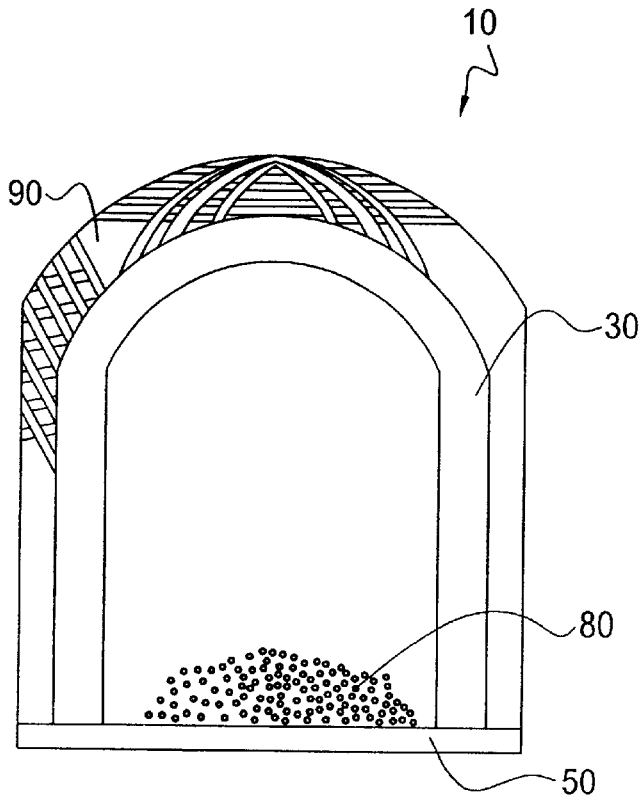
FIG. 5 is a cross-sectional view of a fourth alternative embodiment of the rhythm shaker of the present invention.

In a fourth alternative embodiment shown in FIG. 5, shell 50 has a tubular cross-sectional shape or configuration with a rounded end. In this embodiment, a weave basket 90 is added to the exterior surface of shell 50. Weave basket 90 can be made from plastic, bamboo or other suitable material. Again, percussive media 80 are allowed to strike and make sound on only one side or surface of shell 50 with the remaining shell surfaces being insulated by dampening insert 30.

Figure 6:
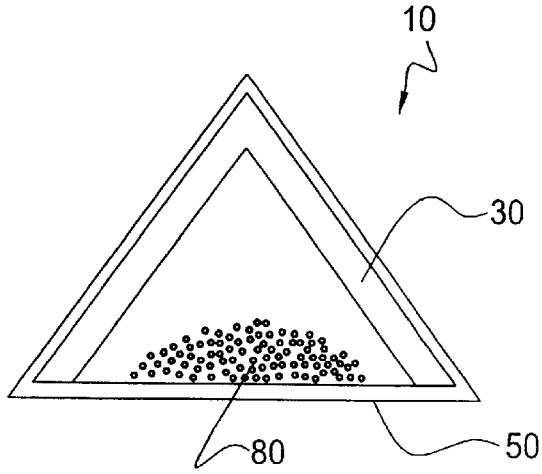
FIG. 6 is a cross-sectional view of a fifth alternative embodiment of the rhythm shaker of the present invention.

In a fifth alternative embodiment shown in FIG. 6, the shell 50 has a triangular cross-sectional configuration or shape. In this embodiment, percussive media 80 are allowed to strike, and thus make a sound, on only one of the three sides or surfaces of shell 50 with dampening insert 30 insulating or preventing the other two sides from being stricken by the percussive media.

The present invention having been thus been described with particular reference to the preferred forms thereof, it will be obvious that various changes and modifications may be made therein without departing from the spirit and scope of the present invention as defined in the appended claims.

What is claimed is:

1. A percussive shaker instrument comprising:

a rigid member having a member body with an interior surface, said member body having a hollow interior;

a dampening insert adapted to fit inside said hollow interior of said member, said dampening insert having an insert body with a single opening therein, said body forming a cavity; and a plurality of fill particles loosely disposed in said cavity for striking a portion of said interior surface of said member when the shaker is moved.

2. The percussive shaker instrument of claim 1, wherein said member has at least one end cap.

3. The percussive shaker instrument of claim 1, wherein said member has two end caps.

4. The percussive shaker instrument of claim 1, wherein said member has one end cap.

5. The percussive shaker instrument of claim 1, wherein said dampening insert is a container having the same general shape as said member.

6. The percussive shaker instrument of claim 1, wherein said dampening insert defines a hollow interior, and said dampening insert has only one open surface.

7. The percussive shaker instrument of claim 1, wherein said dampening insert is positioned in said hollow interior of said member with said opening in direct communication with a portion of said interior surface of said member.

8. The percussive shaker instrument of claim 7, wherein said plurality of fill particles only contact said dampening insert and said portion of said interior surface of said member.

9. The percussive shaker instrument of claim 1, wherein said plurality of fill particles is selected from the group consisting of metal shot, buckshot, plastic bead, glass bead, pellet, seed, rice, stone, and any combinations thereof.

10. The percussive shaker instrument of claim 1, wherein said member is rigid.

11. The percussive shaker instrument of claim 1, wherein said member is made from a material selected from the group consisting of plastic, metal, wood, bamboo, and any combinations thereof.

12. The percussive shaker instrument of claim 2, wherein said at least one end cap is made from a material selected from the group consisting of plastic, metal, wood, bamboo, and any combinations thereof.

13. The percussive shaker instrument of claim 1, wherein said dampening insert is made from a material selected from the group consisting of cloth, rubber, silicone, foam, and any combinations thereof.

14. The percussive shaker instrument of claim 2, wherein said member body envelops said dampening insert, said cavity, and said plurality of fill particles, and wherein said at least one end cap is connected to member body to form a continuous surface on member body.

15. The percussive shaker instrument of claim 1, wherein said member has a hexagonal cross-sectional configuration.

16. The percussive shaker instrument of claim 1, wherein said member has a circular cross-sectional configuration.

17. The percussive shaker instrument of claim 1, wherein said member has a square cross-sectional configuration.

18. The percussive shaker instrument of claim 1, wherein said member has a tubular cross-sectional configuration with a rounded end.

19. The percussive shaker instrument of claim 1, wherein said member has a triangular cross-sectional configuration.

20. The percussive shaker instrument of claim 1, wherein said member body has an exterior surface with a weave basket or other ornamental design added thereto.

21. The percussive shaker instrument of claim 1, wherein said dampening insert dampens or prevents sound in non-contact areas.

22. A percussive shaker instrument comprising:

a rigid member having a member body with an interior surface, said member body having a hollow interior;

a dampening insert adapted to fit inside said hollow interior of said member, said dampening insert having an insert body with a single opening therein, said body forming a cavity; and a plurality of fill particles loosely disposed in said cavity for striking a portion of said interior surface of said member when the shaker is moved, wherein said plurality of fill particles is selected from the group consisting of metal shot, buckshot, plastic bead, glass bead, pellet, seed, rice, stone, and any combinations thereof.

23. The percussive shaker instrument of claim 22, wherein said member is made from a material selected from the group consisting of plastic, metal, wood, bamboo, and any combinations thereof.

24. The percussive shaker instrument of claim 22, wherein said dampening insert is made from a material selected from the group consisting of cloth, rubber, silicone, foam, and any combinations thereof.

25. The percussive shaker instrument of claim 22, wherein said member has at least one end cap.

26. The percussive shaker instrument of claim 25, wherein said at least one end cap is made from a material selected from the group consisting of plastic, metal, wood, bamboo, and any combinations thereof.

27. A percussive shaker instrument comprising:

a rigid member having a member body with an interior surface, said member body having a hollow interior and said member having a nominal wall thickness to produce percussive sound;

a dampening insert adapted to fit inside said hollow interior of said member, said dampening insert having an insert body with a single opening therein, said body forming a cavity; and a plurality of fill particles loosely disposed in said cavity for striking a portion of said interior surface of said member when the shaker is moved.

* * * * *